US007241174B2

(12) United States Patent
Tsai

(10) Patent No.: US 7,241,174 B2
(45) Date of Patent: Jul. 10, 2007

(54) ELECTRICAL CONNECTOR WITH A METAL HOUSING

(76) Inventor: Chou Hsuan Tsai, 15F,No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/398,395

(22) Filed: Apr. 4, 2006

(65) Prior Publication Data

US 2006/0234554 A1 Oct. 19, 2006

(30) Foreign Application Priority Data

Apr. 15, 2005 (TW) ..... 94205978 U

(51) Int. Cl.
*H01R 13/648* (2006.01)

(52) U.S. Cl. ..... 439/607

(58) Field of Classification Search ..... 439/607, 439/541.5, 567, 570
See application file for complete search history.

(56) References Cited

U.S. PATENT DOCUMENTS 5,304,069 A * 4/1994 Brunker et al. ..... 439/108
5,863,222 A * 1/1999 Kinsey et al. ..... 439/607
6,109,968 A * 8/2000 Wang ..... 439/607
6,132,247 A * 10/2000 Liou et al. ..... 439/567
6,139,362 A * 10/2000 Brown ..... 439/567
6,174,198 B1 * 1/2001 Wu et al. ..... 439/541.5
6,468,108 B1 * 10/2002 Wu ..... 439/567
6,520,799 B1 * 2/2003 Cheng et al. ..... 439/541.5
6,540,563 B1 * 4/2003 Hu et al. ..... 439/676
6,629,859 B2 * 10/2003 Hoshino et al. ..... 439/607
6,699,071 B1 * 3/2004 Hyland ..... 439/607
6,733,332 B1 * 5/2004 Espenshade et al. ..... 439/541.5
6,827,605 B2 * 12/2004 Wu ..... 439/567
6,835,092 B2 * 12/2004 Wan et al. ..... 439/541.5
6,926,557 B1 * 8/2005 Yamaguchi et al. ..... 439/607

* cited by examiner

*Primary Examiner*—Tulsidas C. Patel
*Assistant Examiner*—Harshad C Patel
(74) *Attorney, Agent, or Firm*—Pro-Techtor Int'l Services

(57) ABSTRACT

An electrical connector includes a plastic base, a metal housing, a plate-engaging element and a grounding element. A connection portion and terminals each having a pin portion extending out of the plastic base are disposed on the plastic base. The metal housing covers the plastic base while exposing the connection portion of the plastic base and the pin portions of the terminals. The plate-engaging element is formed with one elastic hook extending below the plastic base to engage with a connection hole of a circuit board. The grounding element contacting the metal housing is formed with a positioning piece extending below the plastic base and being positioned by a grounding hole of the circuit board. The plate-engaging element and the metal housing pertain to different parts. The plate-engaging element is formed with a fixing portion engaging with the plastic base.

10 Claims, 9 Drawing Sheets

ELECTRICAL CONNECTOR WITH A METAL HOUSING

BACKGROUND OF THE INVENTION

1. Field of the Invention

The invention relates to an electrical connector, and more particularly to an electrical connector with a metal housing.

2. Description of the Related Art

Referring to FIGS. 1 and 2, a conventional electrical connector with two USB (Universal Serial Bus) plugs and one network transmission plug (e.g., RJ45 plug) includes a plastic base 10 and a metal housing 20. The front end of the plastic base 10 is formed with, from bottom to top, two connection portions 11 and one connection portion 12. Multiple terminals 13 are disposed in the plastic base 10. The metal housing 20 is composed of a front housing 21 and a rear housing 22. The metal housing 20 covers the plastic base 10 with the connection portions 11 and 12 of the plastic base and the pin portions of the terminals 13 communicating with the outside. A front plate of the front housing 21 is formed with openings 23 and 24 in conjunction with the connection portions 11 and 12. The peripheries of the openings 23 and 24 are formed with grounding elastic pieces 25 extending toward the connection portions 11 and 12. Lower edges of two side plates are integrally formed with grounding elements 26 and plate-engaging elements 27 extending downward. The plate-engaging elements 27 are first bent toward the middle of the bottom surface of the plastic base 10 and then bent downward in order to match with engaging holes of a circuit board.

According to the above-mentioned structure, the two connection portions 11 may be connected to two USB plugs, the connection portion 12 can be connected to one RJ45 plug, the grounding elastic piece 25 may elastically contact the inserted USB plugs or RJ45 plug, the grounding elements 26 may be inserted into grounding holes on the circuit board in advance, and then the plate-engaging elements 27 engage with the engagement holes on the circuit board.

However, the above-mentioned prior art has the following drawbacks.

First, because the lower edges of two sides of the front housing of the metal housing 20 are integrally formed with the grounding elements 26 and the plate-engaging elements 27, the plate-engaging elements 27 must have the proper intensity such that the plate-engaging elements 27 can engage with the circuit board firmly. Thus, the metal housing 20 cannot be made with a thinner plate, or otherwise the plate-engaging element 27 has the insufficient intensity, and the material cannot be saved.

Second, because the lower edges of two sides of the front housing of the metal housing 20 are integrally formed with the grounding elements 26 and the plate-engaging elements 27 by way of pressing, the front housing 21 must be formed by pressing a longer plate into the grounding elements 26 and the plate-engaging elements 27. In particularly, because the plate-engaging element 27 has to be bent toward the middle of the bottom surface of the plastic base and then bent downward, the required length is longer, and the material is further wasted.

SUMMARY OF THE INVENTION

It is therefore an object of the invention to provide an electrical connector having a metal housing and a plate-engaging element separated from the metal housing such that the material cost of the metal housing can be reduced.

To achieve the above-identified object, the invention provides an electrical connector including a plastic base, a metal housing, a plate-engaging element and a grounding element. A connection portion and terminals each having a pin portion extending out of the plastic base are disposed on the plastic base. The metal housing covers the plastic base while exposing the connection portion of the plastic base and the pin portions of the terminals. The plate-engaging element is formed with one elastic hook extending below the plastic base to engage with a connection hole of a circuit board. The grounding element contacting the metal housing is formed with a positioning piece extending below the plastic base and being positioned by a grounding hole of the circuit board. The plate-engaging element and the metal housing pertain to different parts. The plate-engaging element is formed with a fixing portion engaging with the plastic base.

Accordingly, the plate-engaging element and the metal housing pertain to different parts such that the large-area metal housing can be made by an ultra-thin metal plate in order to reduce the manufacturing cost greatly. The plate-engaging element may be made of a thicker metal plate or any other suitable material in order to satisfy the desired elasticity and rigidity.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
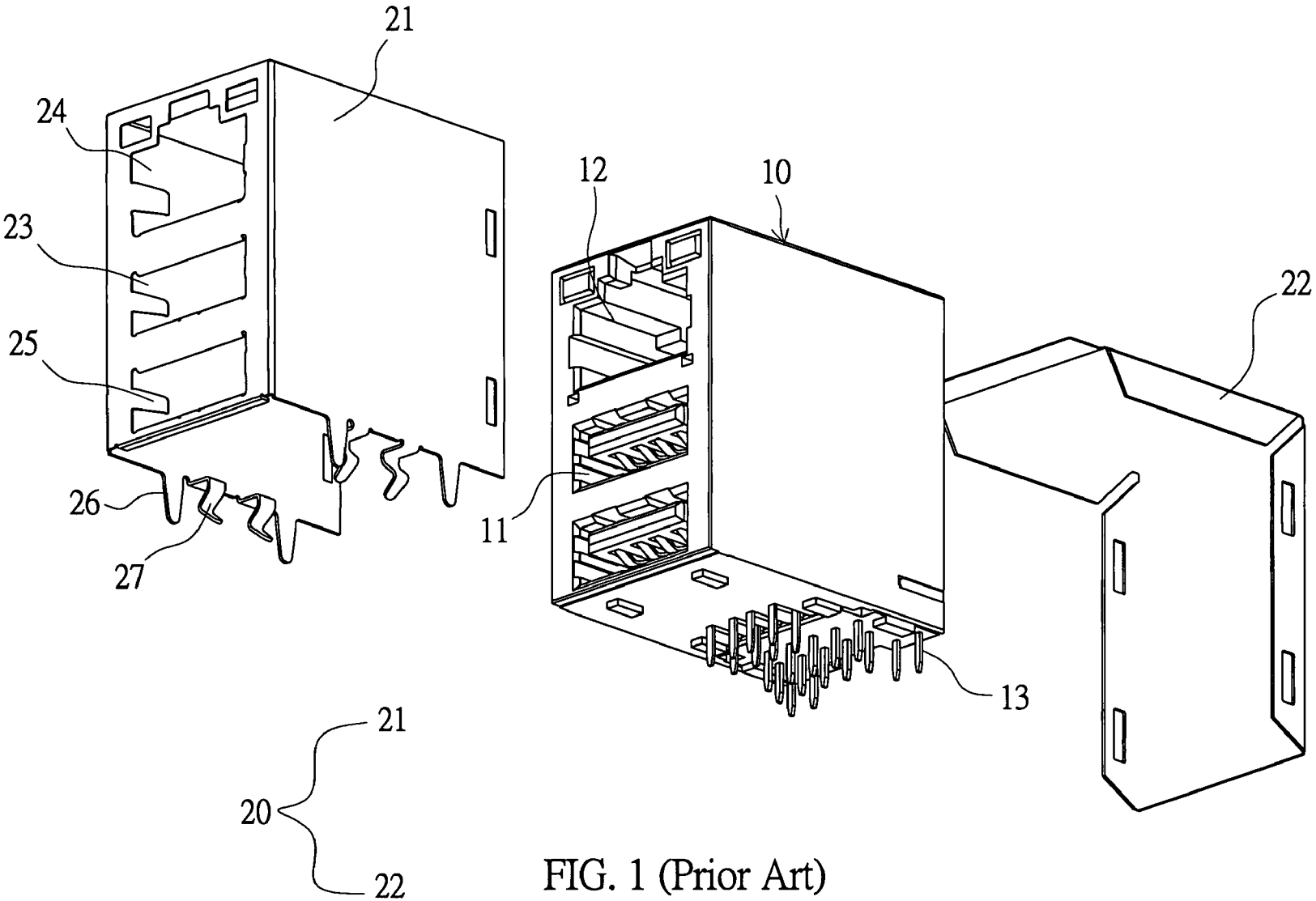
FIG. 1 (Prior Art)
FIG. 1 is a pictorially exploded view showing a conventional electrical connector.
Figure 2:
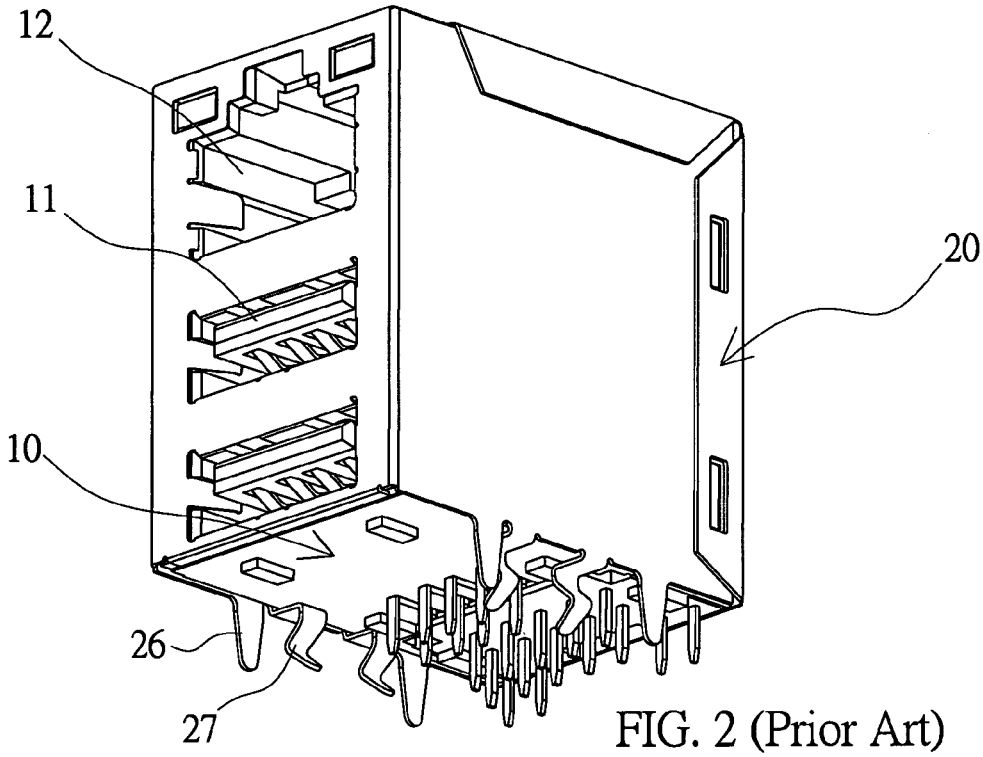
FIG. 2 (Prior Art)
FIG. 2 is a pictorially assembled view showing the conventional electrical connector.
Figure 4:
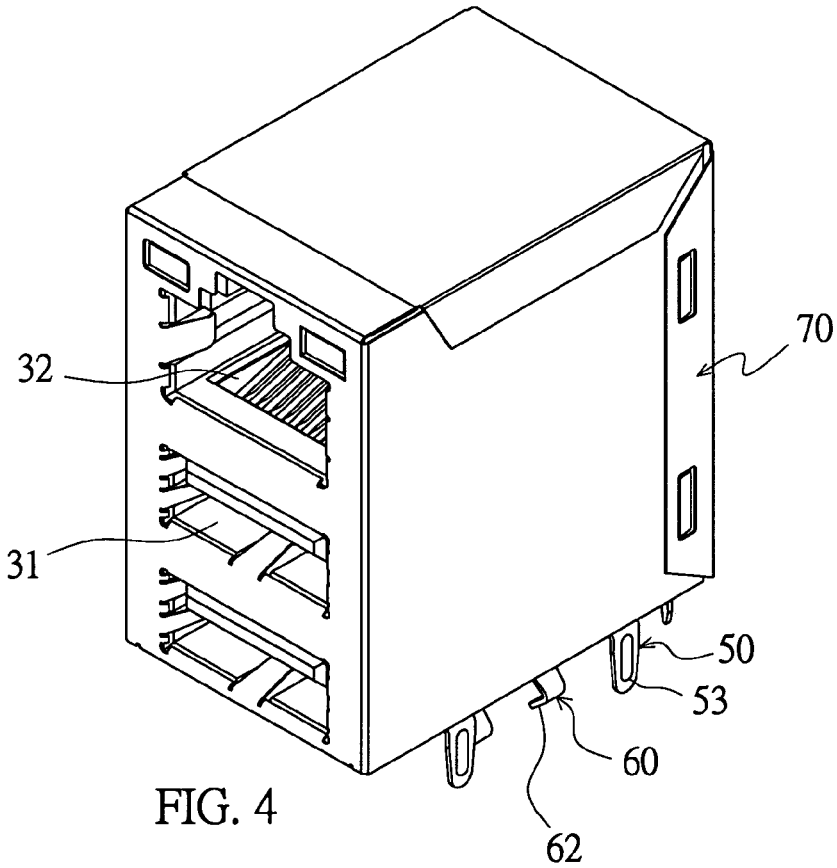
FIG. 4 is a pictorially assembled view showing the electrical connector according to the first embodiment of the invention.
Figure 3:
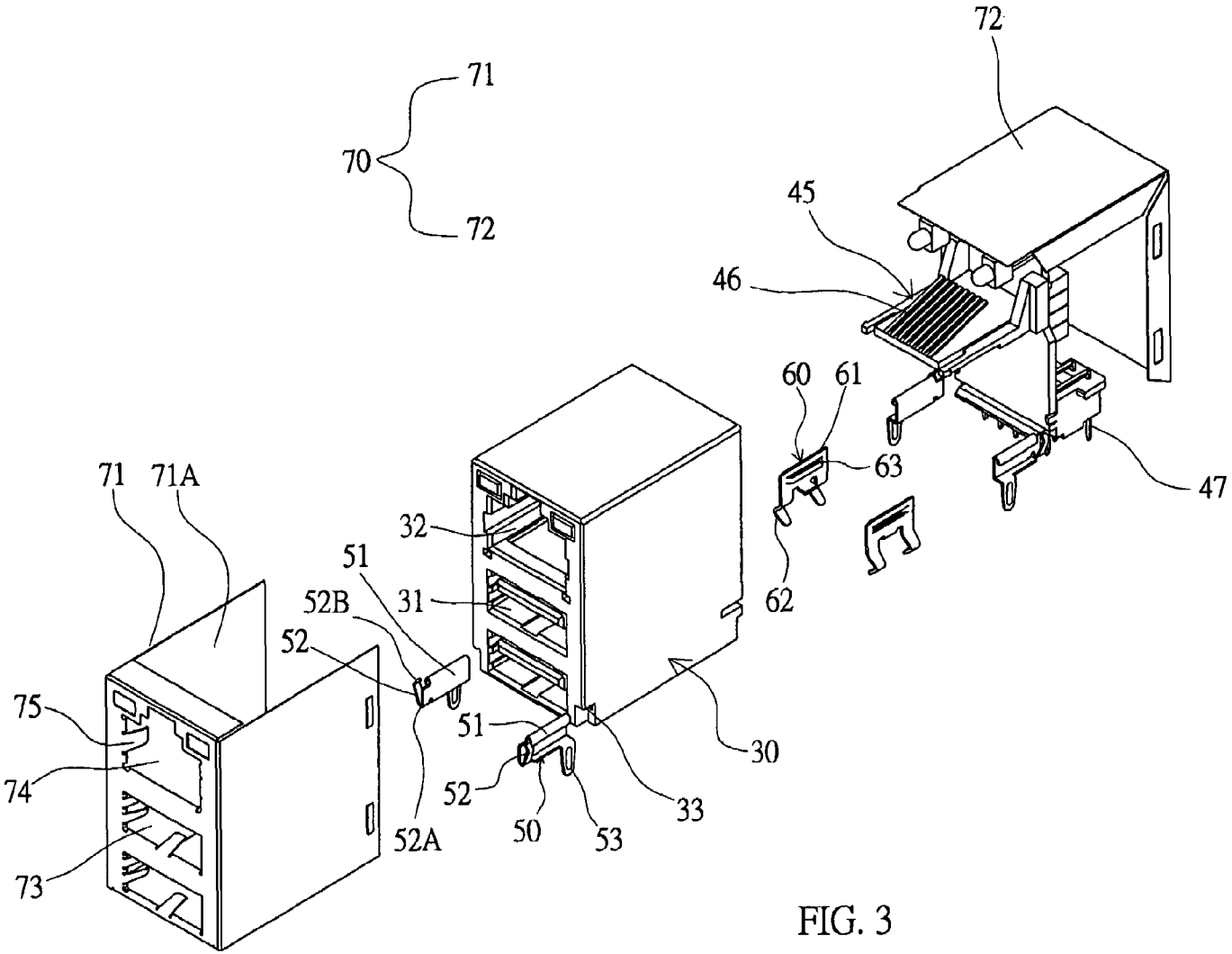
FIG. 3 is a pictorially exploded view showing an electrical connector according to a first embodiment of the invention.
Figure 5:
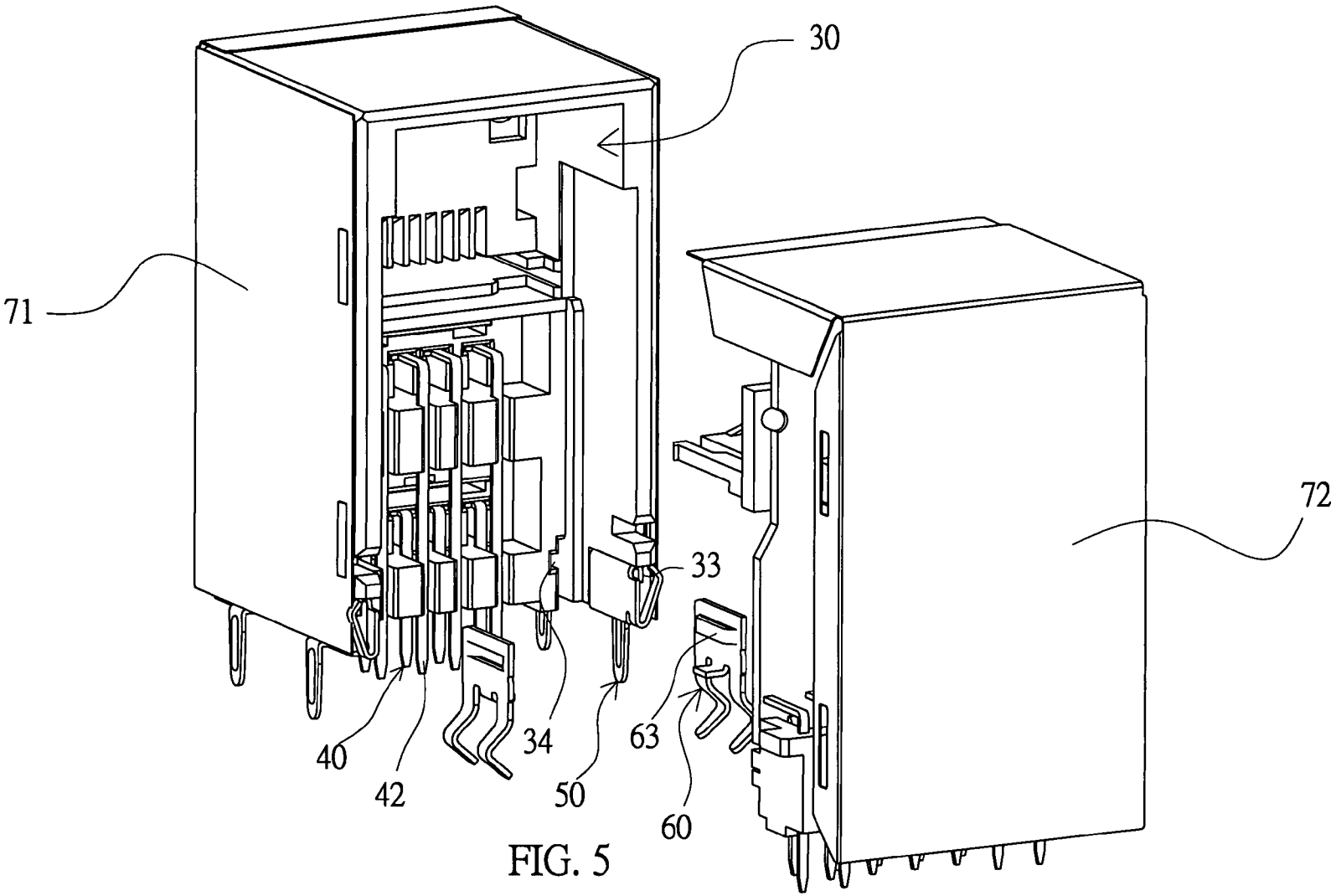
FIG. 5 is a pictorially exploded back view showing the electrical connector according to the first embodiment of the invention.

Referring to FIGS. 3 to 5, an electrical connector to be electrically connected to two USB plugs and one RJ45 plug according to a first embodiment of the invention includes a plastic base 30, an RJ45 terminal set 45, four grounding elements 50, two plate-engaging elements 60 and one metal housing 70.

The front end of the plastic base 30 is formed with, from bottom to top, two connection portions 31 and one connection portion 32. Multiple terminals 40 are disposed in the plastic base 30. The two connection portions 31 are to be electrically connected to the two USB plugs. The connection portion 32 is to be electrically connected to the RJ45 plug. Each terminal 40 has a contact located in the connection portion 31 and a pin portion 42 extending toward the bottom of the plastic base 30. In addition, four corners of the plastic base 30 are formed with slots 33. Two slots 34 are formed inside the two slots 33 at the rear end of the plastic base 30.

The RJ45 terminal set 45 is disposed at the rear end of the plastic base 30. The contacts 46 of the terminals are disposed in the connection portions 32, and the pin portions 47 extend below the plastic base 30.

The grounding element 50 and the metal housing 70 pertain to different parts. The grounding element 50 includes a fixing portion 51, an elastic piece 52 and a positioning piece 53. The fixing portion 51 engages with the slot 33 of the plastic base 30. The elastic piece 52 elastically contacts the metal housing 70. The elastic piece 52 has a connection end 52A connected to the fixing portion 51, and the metal housing 70 has an inner surface 71A for pushing the elastic piece 52 to move a free end 52B of the elastic piece 52 toward the fixing portion 51. The positioning piece 53 extends out of the bottom of the plastic base 30 such that the positioning piece 53 can be connected to and positioned in the grounding hole on a circuit board.

The plate-engaging element 60 includes a fixing portion 61 and two elastic hooks 62. The fixing portion 61 includes a projection 63 engaging with the slot 34 of the plastic base 30, as shown in FIG 5. The elastic hook 62 extends out of the bottom of the plastic base 30 and engages with the engagement hole on the circuit board. The positioning piece 53 of each grounding element 50 protrudes over the plastic base to an extent slightly higher than the elastic hook 62 of the plate-engaging element 60. Thus, the grounding element 50 can be inserted into and then positioned in the grounding hole on the circuit board in advance, and then the plate-engaging element 60 can engage with the engagement hole on the circuit board. In this invention, the plate-engaging element 60 is electrically disconnected from the grounding element 50 and the metal housing 70 because the plate-engaging element 60 and the grounding element 50 are inserted into the plastic base 30. In addition, the plate-engaging element 60 is separated from the metal housing 70 when the plate-engaging element 60 engages with the plastic base 30 because the projection 63 of the plate-engaging element 60 engages with the slot 34 of the plastic base 30. as shown in FIG 5.

The metal housing 70 is made by bending a stainless steel plate with the thickness of 0.1 mm and includes a front housing 71 and a rear housing 72 assembled together. The front housing 71 has a front plate and two side plates. The rear housing 72 having a top plate and a rear plate covers the plastic base 30 and elastically contacts the elastic piece 52 of the grounding element 50. The bottom of the rear housing 72 is open and the front housing 71 has two openings 73 corresponding to the connection portions 31 and one opening 74 corresponding to the connection portion 32. The peripheries of the openings 73 and 74 are formed with grounding elastic pieces 75 extending toward the insides of the connection portions 31 and 32.

According to the above-mentioned structure, each of the grounding element 50 and the plate-engaging element 60 is made of a stainless steel plate with the thickness of about 0.3 mm so that each of the grounding element 50 and the plate-engaging element 60 may have the sufficient intensity and elasticity. The large-area metal housing 70 is made by bending the stainless steel plate (metal thin plate) with the thickness of 0.1 mm, so the material cost can be greatly reduced. In addition, the grounding element and the plate-engaging element are formed without pressing the front housing 71 of the metal housing 70. So, the length of material plate can be greatly shortened, and the material cost can be reduced.

According to the above-mentioned structure, the invention has the following advantages.

First, the grounding element 50, the plate-engaging element 60 and the metal housing 70 pertain to different parts. So, the grounding element 50 and the plate-engaging element 60 may be made of a metal material with the suitable rigidity or elasticity and then assembled and positioned with the plastic base 30 and the low-cost metal housing. Thus, it is unnecessary to integrally form the metal housing 70 with the grounding element 50 and the plate-engaging element 60 in order to satisfy the demands on the local rigidity or elasticity. Thus, the material and manufacturing cost can be reduced. The metal housing 70 with the larger area may be made of an ultra-thin stainless steel plate, and the manufacturing cost can be greatly reduced.

Second, the grounding element 50, the plate-engaging element 60 and the metal housing 70 pertain to different parts. So, the metal housing 20 does not have to be formed by way of pressing, the length of the metal plate can be shortened, and the material can be saved.

Third, because the plate-engaging element 60 is additionally fixed to the plastic base 30, it is unnecessary to bend the element by a length to the bottom surface of the plastic base.

Figure 6:
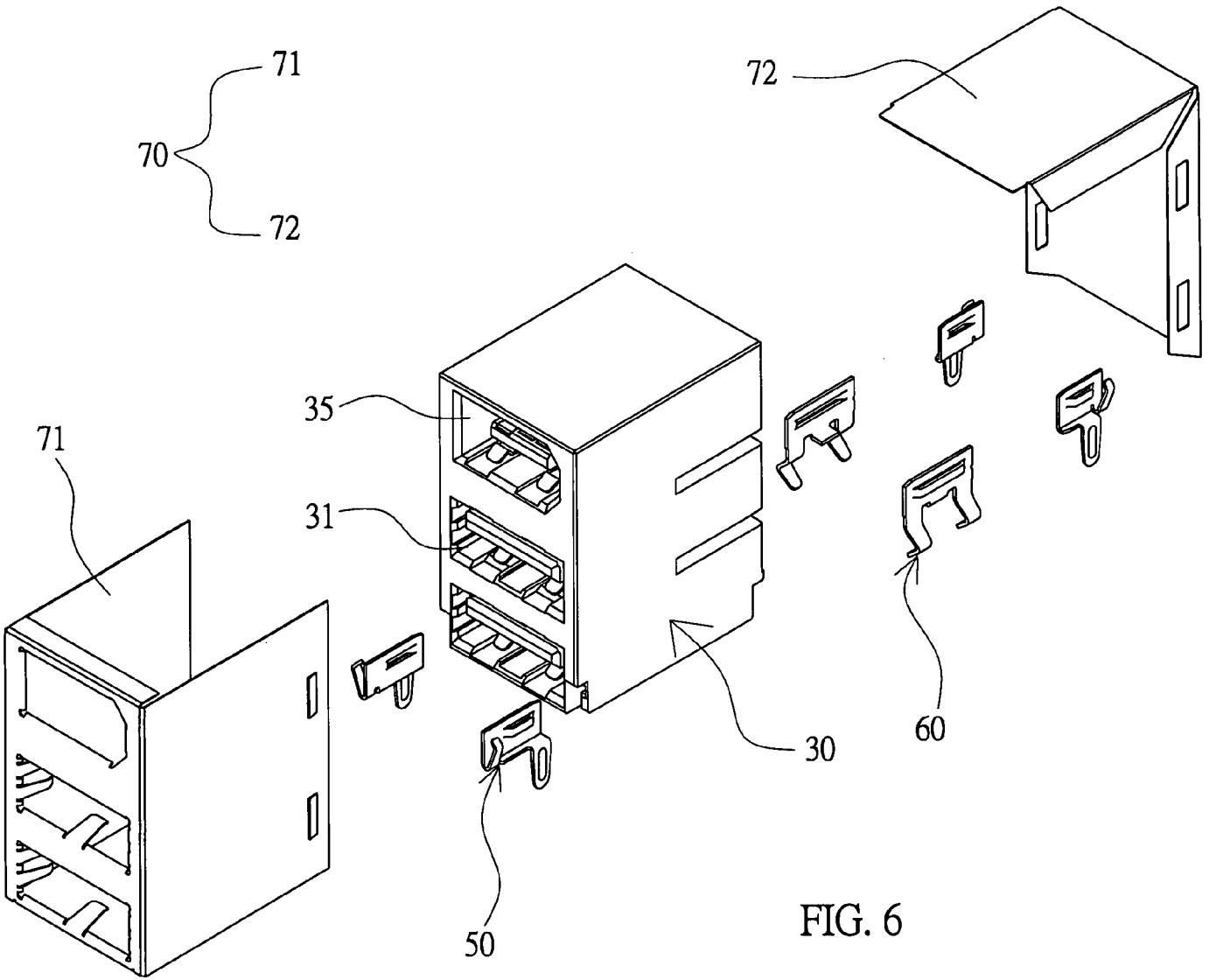
FIG. 6 is a pictorially exploded view showing an electrical connector according to a second embodiment of the invention.
Figure 7:
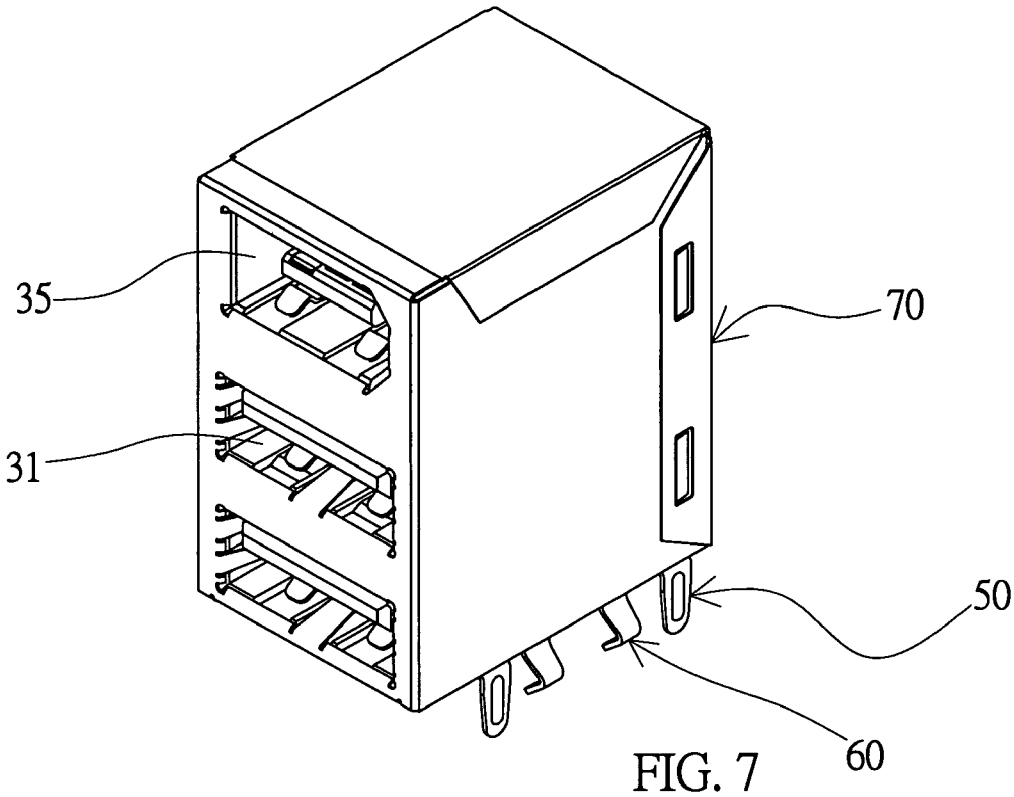
FIG. 7 is a pictorially assembled view showing the electrical connector according to the second embodiment of the invention.

As shown in FIGS. 6 and 7, the second embodiment of the invention is almost the same as the first embodiment except that the connector of the second embodiment is to be connected to two USB plugs and one high-speed serial bus (e.g., IEEE1394) plug. That is, the plastic base 30 has two connection portions 31, which are to be electrically connected to the two USB plugs, and one connection portion 35, which is to be electrically connected to the IEEE1394 plug.

Figure 9:
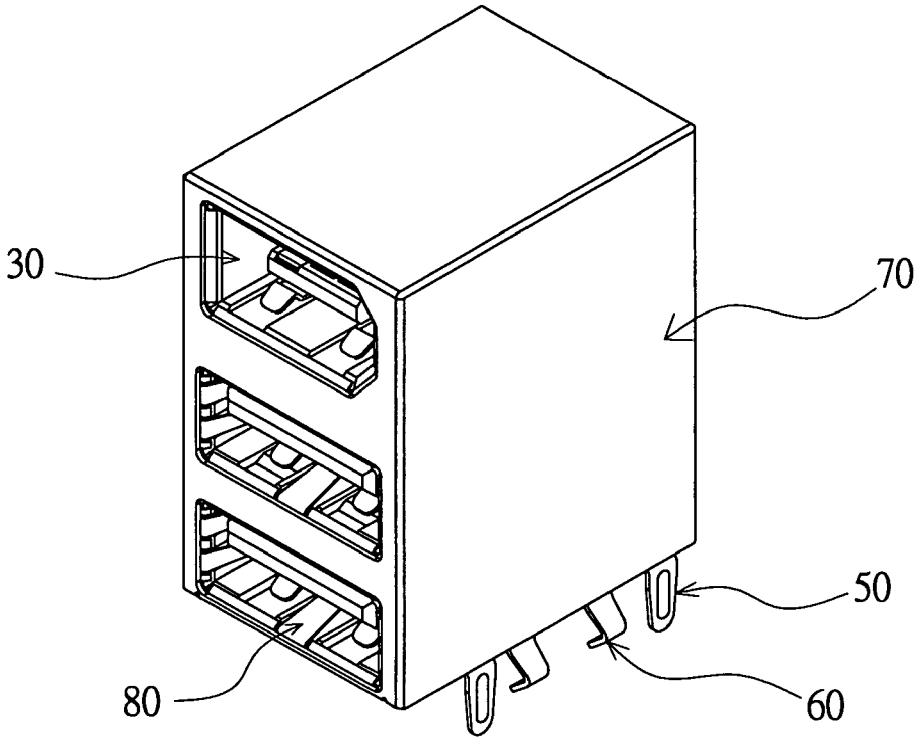
FIG. 9 is a pictorially assembled view showing the electrical connector according to the third embodiment of the invention.
Figure 8:
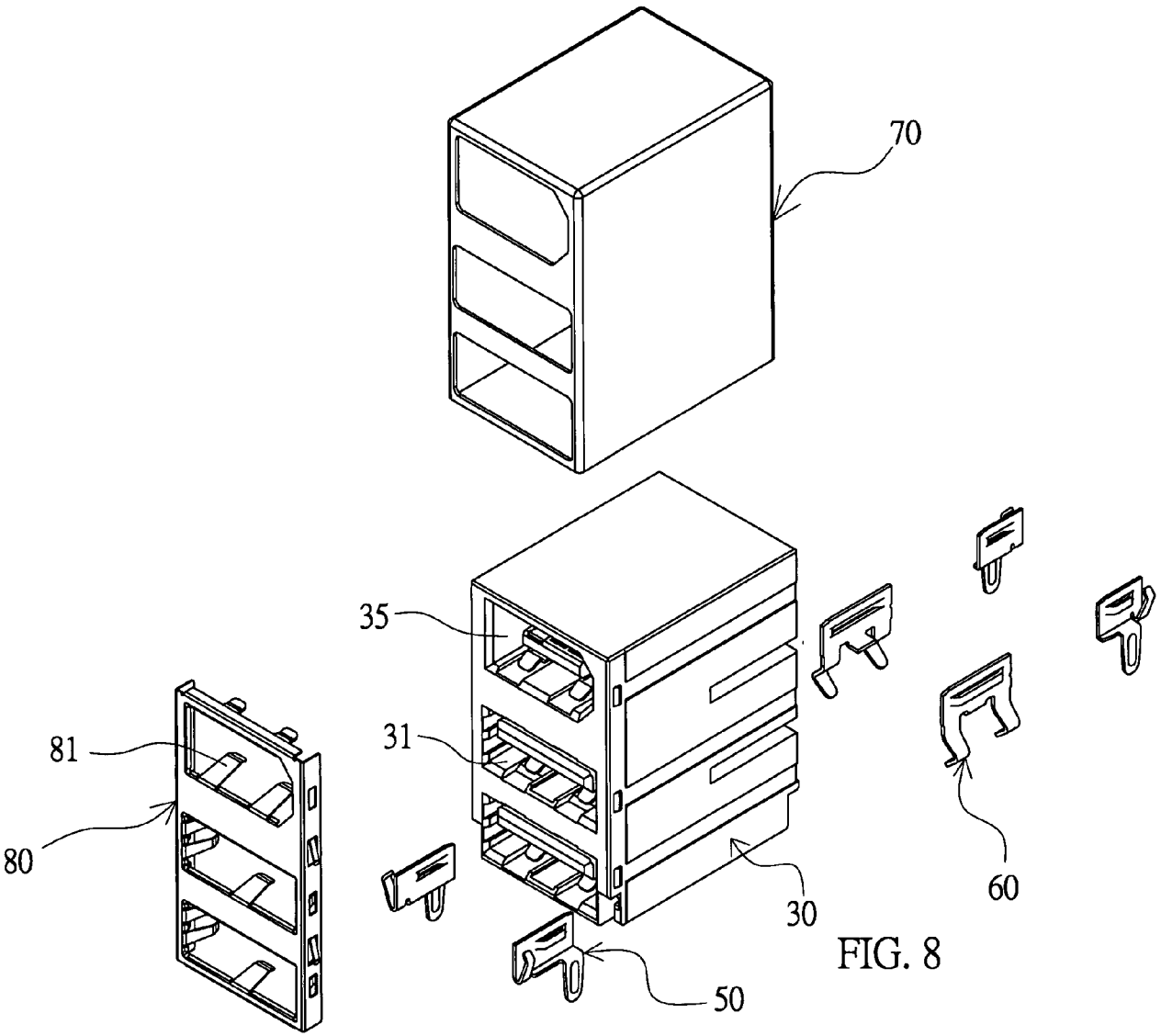
FIG. 8 is a pictorially exploded view showing an electrical connector according to a third embodiment of the invention.

As shown in FIGS. 8 and 9, the third embodiment of the invention is almost the same as the second embodiment except that the metal housing 70 of the third embodiment is made by extruding an aluminum plate into a one-piece molded, seamless housing. In addition, the front end of the plastic base 30 engages with a grounding plate 80, which is formed with grounding elastic pieces 81 extending into the connection portions 31 and the connection portion 35 of the plastic base 30.

Figure 10:
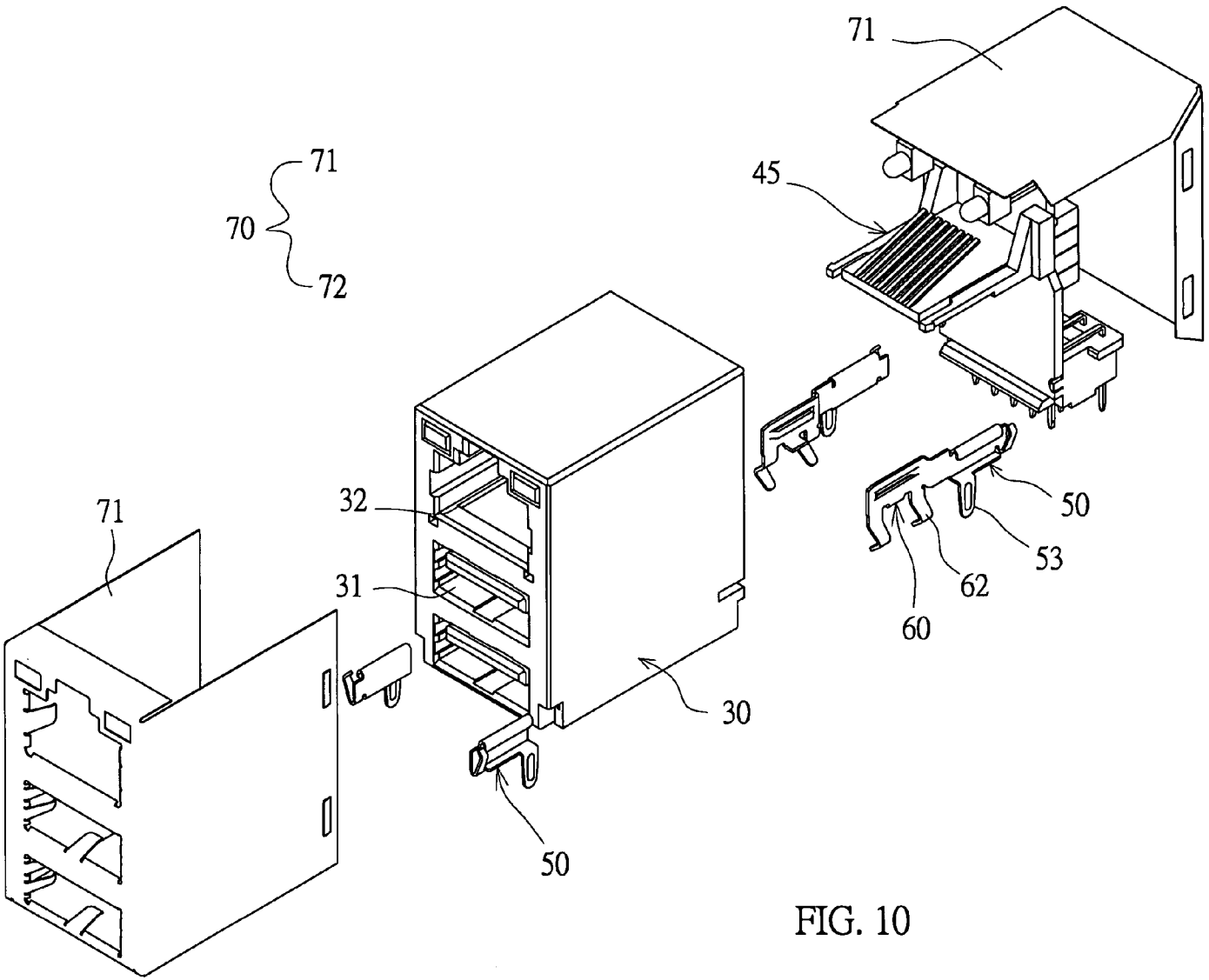
FIG. 10 is a pictorially exploded view showing an electrical connector according to a fourth embodiment of the invention.

As shown in FIG. 10, the fourth embodiment of the invention is almost the same as the first embodiment except that the two rear grounding elements 50 and the two rear plate-engaging elements 60 are integrally formed by pressing a metal plate. The positioning piece 53 of the grounding element 50 slightly protrudes over the bottom of the plastic base to an extent slightly higher than the elastic hook 62 of the plate-engaging element 60, such that the combination of the plastic base 30 and the elements 50 and 60 may be simplified.

Figure 11:
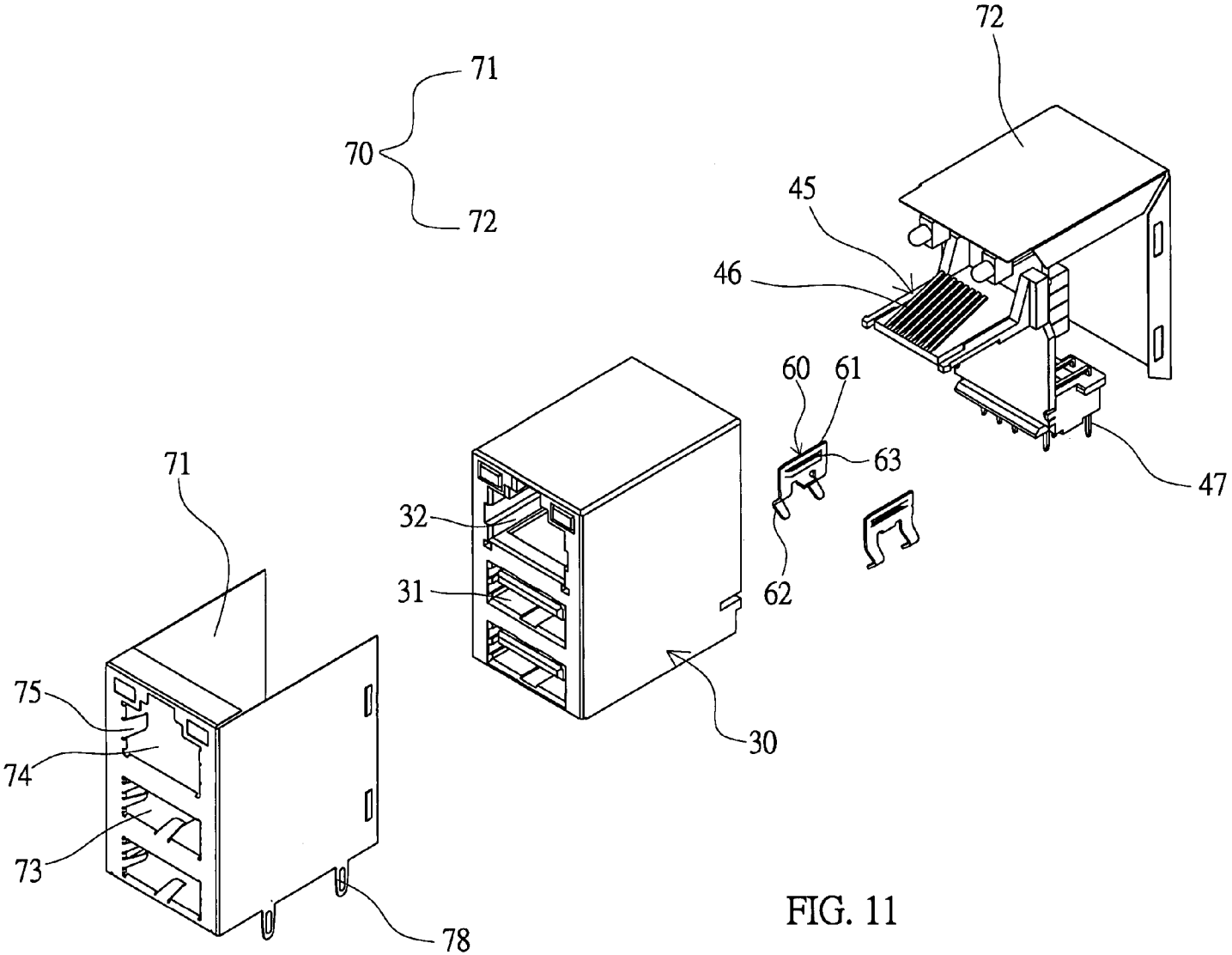
FIG. 11 is a pictorially exploded view showing an electrical connector according to a fifth embodiment of the invention.

As shown in FIG. 11, the fifth embodiment of the invention is almost the same as the first embodiment except that two sides of the bottom of the metal housing 70 of the fifth embodiment are integrally formed with two grounding elements 78. Because the grounding element 78 is only formed with the positioning piece, the material thereof is not long and the rigidity thereof is not high, the integral formation of the metal housing 70 and the grounding elements 78 can simplify the manufacturing processes.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An electrical connector, comprising:

a plastic base, on which at least one connection portion and a plurality of terminals each having a pin portion extending out of the plastic base are disposed;

a metal housing covering the plastic base while exposing the at least one connection portion of the plastic base and the pin portions of the terminals;

at least one plate-engaging element formed with at least one elastic hook extending below the plastic base to engage with a connection hole of a circuit board; and at least one grounding element, which contacts the metal housing and is formed with a positioning piece extending below the plastic base and being positioned by a grounding hole of the circuit board, wherein the at least one plate-engaging element and the metal housing pertain to different parts, the at least one plate-engaging element is formed with a fixing portion fixed to the plastic base and an elastic piece having a connection end connected to the fixing portion, and the metal housing has an inner surface for pushing the elastic piece to move a free end of the elastic piece toward the fixing portion.

2. The connector according to claim 1, wherein the plastic base is formed with a slot, and the fixing portion of the at least one plate-engaging element is formed with a projection engaging with the slot of the plastic base.

3. The connector according to claim 1, wherein the metal housing is made by extruding an aluminum material to form a one-piece molded, seamless housing.

4. The connector according to claim 1, wherein the metal housing is formed by pressing and bending a metal plate.

5. The connector according to claim 1, wherein the at least one plate-engaging element is thicker than the metal housing.

6. The connector according to claim 1, wherein the at least one grounding element protrudes over the plastic base to an extent slightly higher than the at least one plate-engaging element.

7. The connector according to claim 1, wherein the at least one grounding element and the at least one plate-engaging element are integrally formed by pressing a metal plate.

8. The connector according to claim 1, wherein the plastic base has at least two kinds of connection portions for different connecting purposes.

9. The connector according to claim 8, wherein the plastic base has two connection portions for USB plugs and one connection portion for an RJ45 plug.

10. The connector according to claim 8, wherein the plastic base has two connection portions for USB plugs and one connection portion for an IEEE1394 plug.

* * * * *